US005180318A

United States Patent [19]

Möller et al.

[11] Patent Number: 5,180,318

[45] Date of Patent: Jan. 19, 1993

[54] FLUIDIC CONNECTOR STRIP WITH BASE PLATE MODULES AND A SOLENOID VALVE FOR EACH MODULE

[75] Inventors: Rudolf Möller, Gehrden; Walter Brausfeld, Hanover; Helmut Göttling, Isernhagen; Gerhard Scharnowski, Gehrden; Peter Müller, Hanover, all of Fed. Rep. of Germany

[73] Assignee: Mannesmann Aktiengesellschaft, Düsseldorf, Fed. Rep. of Germany

[21] Appl. No.: 721,932

[22] Filed: Jun. 27, 1991

[30] Foreign Application Priority Data

Jun. 28, 1990 [DE] Fed. Rep. of Germany ..... 4020791

[51] Int. Cl.[5] ..... H01R 9/26

[52] U.S. Cl. ..... 439/716; 137/884; 439/928

[58] Field of Search ..... 251/129.15; 137/596.17, 137/884; 439/34, 190, 191, 196, 712–716, 928, 929

[56] References Cited

U.S. PATENT DOCUMENTS

| | | | |
|---|---|---|---|
| 3,934,605 | 1/1976 | Legris | 137/884 X |
| 4,224,957 | 9/1980 | Darves et al. | 137/884 X |
| 4,399,836 | 8/1983 | Versterre et al. | 137/884 X |
| 4,469,128 | 9/1984 | Petrimaux et al. | 137/596.17 X |
| 4,557,292 | 12/1985 | Nicolas et al. | 137/884 X |
| 4,861,232 | 8/1989 | Ise et al. | 137/884 X |
| 4,938,258 | 7/1990 | Sato | 137/884 |
| 4,956,747 | 9/1990 | Beer et al. | 439/716 X |

FOREIGN PATENT DOCUMENTS

| | | |
|---|---|---|
| 2852685 | 4/1987 | Fed. Rep. of Germany . |
| 3331594 | 2/1988 | Fed. Rep. of Germany . |
| 3834815 | 4/1990 | Fed. Rep. of Germany . |
| 4020791 | 6/1991 | Fed. Rep. of Germany . |
| 552755 | 8/1974 | Switzerland . |

*Primary Examiner*—Larry I. Schwartz
*Assistant Examiner*—Khiem Nguyen
*Attorney, Agent, or Firm*—Horst M. Kasper

[57] ABSTRACT

A solenoid valve battery includes in each case a solenoid valve (9), which exhibits coil contacts and can be constructed advantageously for the variation of the number of device components for the handling of connections and for cable assembly as well as with respect to its device size. A pluggable connector module (13) is furnished for the contacting of the protective grounded conductor (19), of the signal line, and of the neutral conductor (20). At least one protective grounded conductor (19) and/or a parallel running neutral conductor (20) are through-connected and running in the longitudinal extension direction (17) of the strip. The grounded conductor (19) and the neutral conductor (20) can be contacted by plugging the connector modules (13) together in longitudinal direction. A signal line (21) is furnished individually at each connector module (13) and includes a connector clamp (23) at an input (22) and a connection to the corresponding coil contact (20*a*) at an output (24).

21 Claims, 5 Drawing Sheets

13
18
36
50
37
34
33a
35
2
35
33b
34
50
52
13

FLUIDIC CONNECTOR STRIP WITH BASE PLATE MODULES AND A SOLENOID VALVE FOR EACH MODULE

BACKGROUND OF THE INVENTION

1. Filed of the Invention

The invention relates to fluidic connector strip with base plate modules and in each case a solenoid valve, which includes an armature and a coil with coil contacts, wherein a connector for the coil terminals includes in each case a grounded conductor, a signal line and a neutral conductor.

2. Brief Description of the Background of the Invention Including Prior Art

Such fluidic connector strips comprise several valves, sequentially disposed next to each other, such as, for example, directional valves. Such directional valves and series base plates can be plugged together without tools. The production of the casings out of thermoplastic materials is associated with a lowest possible weight and such thermoplastic casings are additionally resistant to corrosion.

A device with base plates for a valve battery is known from the German Patent DE-2,852,685. According to the German reference, a valve battery includes several base plates and two terminal parts. The base plates and the terminal parts are lockingly engaged to each other by way of hook-shaped projections.

In case of a use of several solenoid valves, it is required that each valve is connected to a supply line for the pressure medium, to a line for the pneumatic output signal, and further to an electrical signal line, and at least to one electrical feedback line, where possibly a grounded conductor is to be added to the electrical feed back lines.

The pressure medium P is fed in through a joint pipe carrier and the return line R of the pressure medium is also provided by a second joint pipe carrier serving to provide for feeding and discharging of the fluids.

Only the electrical conductor for the electrical input signal and the pipe line for the pneumatic output signal is to be connected in case of a connection of such a fluidic connector strip comprising base plate modules and solenoid valves.

Thus the connection of each individual solenoid valve with the current feed is not economical and technically incomplete since at least two electrical conductors have to be provided for each solenoid valve to be led to a plug socket and since the two electrical conductors have to be clamped together. The production of the cable assembly of such a solenoid valve battery is difficult during a final assembly step while using commercially available plug sockets because of the small device size.

According to further state of the art not documented in a printed publication, in each case a conductor for the input signal, in each case a further conductor for the neutral phase and possibly also a further conductor for the protective ground contact is required. In this case, a conductor is pulled and looped through the battery, however, all other conductors are individually connected.

SUMMARY OF THE INVENTION

Purposes of the Invention

It is an object of the present invention to provide a fluidic connector strip including base plate modules and in each case a solenoid valve, which can be arbitrarily expanded and which still allows for a very simple cable connection in case of addition of one or several device components.

It is another object of the present invention to provide a connector strip for fluidic media which is compact and which is substantially pre-assembled.

It is yet a further object of the present invention to provide a connector strip for fluidic media which can be easily assembled locally by simple plugging together of components and end sections.

These and other objects and advantages of the present invention will become evident from the description which follows.

Brief Description of the Invention

According to the present invention there is provided for a fluidic connector module for forming a fluidic connected strip. A base plate module includes first base plate module attachment means and second base plate module attachment means. A solenoid valve includes an armature, a coil with coil contacts, first solenoid valve attachment means and second solenoid valve attachment means, with a protective conduit and with a signal line including a coil contact. Said solenoid valve is attached with the first solenoid valve attachment means to the first base plate module attachment means of the base plate module. A first pluggable connector module includes first pluggable connector module attachment means for attaching to the second base plate module attachment means. Second pluggable connector module attachment means of the first pluggable connector module includes a protective conduit and a signal line for attachment to the second solenoid valve attachment means of the solenoid valve and further an output having a terminal contact connector to engage the coil contact. Third pluggable connector module attachment means of the first pluggable connector module includes a protective conduit and a signal line for attachment to a fourth pluggable connector module attachment means of a second like pluggable connector module. Fourth pluggable connector module attachment means of the first pluggable connector module includes a protective conduit and a signal line for attachment to a third pluggable connector module attachment means of a third like pluggable connector module. The third pluggable connector module attachment means of the first pluggable connector module is plug-connectable to the fourth pluggable connector module attachment means of the second pluggable connector module. The third pluggable connector module attachment means of the first pluggable connector module and the fourth pluggable connector module attachment means of the first pluggable connector module are disposed such that like pluggable connector modules attached to the third pluggable connector module attachment means of the first pluggable connector module and attached to the fourth pluggable connector module attachment means of the first pluggable connector module have corresponding points of the second pluggable connector module and of the third pluggable connector module disposed on respective parallel straight lines. The protective conduit and the signal line are through-connected through the first pluggable connector module, the second pluggable connector module, and the third pluggable connector module in an attachment position.

A connector clamp attached to the signal line can be furnished individually at the connector module for a signal line cable at an input.

The connector module can be made of a nonconducting plastic material. A protective grounded conductor can be produced of a flat part and can be disposed in a superposed plane relative to the protective conduit in the connector module.

The protective grounded conductor and the protective conduit can be disposed at an angle of 90° relative to each other in the superposed planes. The protective grounded conductor and the protective conduit can be produced from flat parts.

The connector module can be made of a non-conducting plastic material. A neutral conductor produced of flat parts and can be disposed in superposed planes relative to the protective conduit in the connector module.

The protective conduit and the neutral conductor can be disposed at an angle of 90° relative to each other in the superposed planes. The protective conduit and the neutral conductor can be produced from flat parts.

The signal line of the pluggable connector can be made of a flat part. The flat part can exhibit a first upper section bent toward an input of the connector clamp and a second section, following to the first section, bent downwardly into a lower plane. The flat part of the signal line can form a connection to the coil contact.

The base plate module can be pluggable and can be formed at its front face with a plug guide for the connector module.

A plug guide can be disposed at the connector module and can comprise a dovetail spring closed at an end of the dovetail spring. Said plug guide at the base plate module can comprise an open dovetail groove running through a side of the base plate module.

A spring-supported bolting plate can be furnished at the pluggable connector. An actuating slider for the spring-supported bolting plate can effect the bolting and unbolting, respectively, of the solenoid valve.

According to the invention the following features are provided for the connector strip:

- a connector module is pluggable together for the contacting of the protective grounding contact conductor, of the signal line, and of the neutral conductors,
- at least one looped through protective grounding contact conductor and/or a parallel running neutral conductor are running in the longitudinal direction of the strip,
- the looped through protective contact conductor and/or the parallel running neutral conductor can be contacted by a plugging together of the connector modules in longitudinal direction, and
- a signal line, which is individually provided at each connector module and which includes a connection terminal for a signal line cable at an input and a connection to the corresponding coil contact terminal at an output.

This construction allows to employ a desired number of device components, wherein only a signal line cable has to be connected to each individual device component, while both a neutral conductor and a grounded conductor are looped through along the entire solenoid valve battery based on a plugging together of the connector modules. The cable assembly is thereby substantially simplified, such that for all practical purposes only the signal line cable has to be put in place in a cable channel for each solenoid valve. The connection of an individual signal line cable, however, is extremely advantageous based on the preferred connector terminal clamp at an input of a connector module. Overall, there results therefore a substantially improved component size and the handling during assembly of such a solenoid valve battery unit as well as the connection at the place of application are simplified.

According to a further embodiment of the invention a grounded conductor, produced from flat parts, and a neutral conductor are in each case disposed in planes, disposed above each other, in the connector module produced of a non-conducting plastic material. This kind of grounded conductor structure or, neutral conductor structure corresponds to the requirement of a space saving and respectively compact construction.

A further improvement is provided in that the grounded conductor, produced of flat parts and the neutral conductor run in each case substantially perpendicular in the superposed planes. This step is particularly advantageous in view of the grounded conductor or neutral conductor, respectively, running in the longitudinal direction of the strip and the solenoid valve terminal contacts to be connected perpendicular to the running direction of the grounded conductor and of the neutral conductor.

Correspondingly, it is advantageous that the signal line is made of a flat part, which exhibits a first upper section which is bent toward the input of the connector clamp, and a second lower section following to the first section, which second section is bent into a lower plane and forms the connection to the coil contact terminal.

The pluggable base plate modules are furnished at their front faces in each case with a plug guide for the connector module thereby achieving a further invention object of a compact construction.

Based on the plastic injection molding technique, the parts can be constructed such that the plug guide at the connector modules comprises a dovetail spring, which is closed at an end, and the plug guide at the base plate module is formed out of an extending-through-out, open dovetail groove.

In order to furnish also the lockable engagement for the solenoid valves with magnets disposed on two sides, which engagement again has to be disposed in a space-saving manner, it is disclosed that an actuator slider for a spring supported bolting plate is furnished at the connector module, which actuator slider effects the bolting or the unbolting, respectively, of the solenoid valves.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 2:
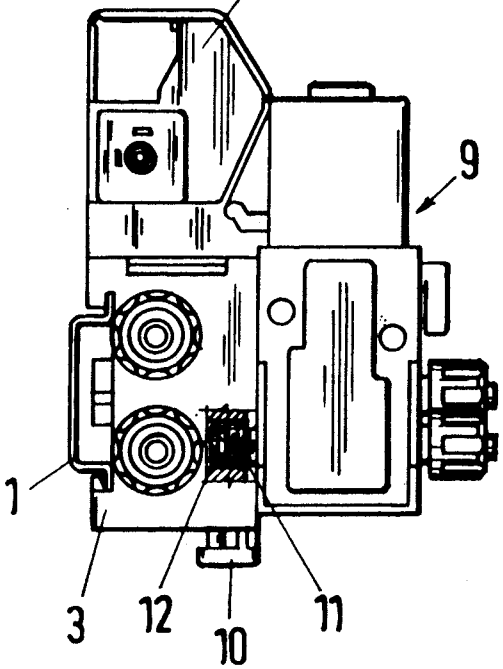
FIG. 2 is a side elevational view of the embodiment of FIG. 1.

The present invention provides for a fluidic connector strip with base plate modules and in each case a solenoid valve. The solenoid valve exhibits an armature and a coil with coil contacts. A connector for the coil contacts comprises in each case a protective grounded conductor, a signal line, and a neutral conductor. A pluggable connector module 13 is provided for the contacting of the protective grounded conductor 19, of the signal line 21, and of the neutral conductor 20. At least one protective grounded conductor 19 is through-connected and running in the longitudinal extension direction 17 of the strip and a parallel running neutral conductor 20. The protective grounded conductor and the neutral conductor 20 can be contacted by plugging the connector modules 13 together in longitudinal direction. The signal line 21, furnished individually at each connector module 13, includes a connector clamp 23 for a signal line cable 21*b* at an input, and a terminal contact connector 25 to a corresponding coil contact 21*a* at an output 24.

The connector module 13 can be made of a non-conducting plastic material. An each case a protective grounded conductor 19, 19*a* and a neutral conductor 20, 20*a*, produced of flat parts, can be disposed in superposed planes 13*a* in the connector module 13. The protective grounded conductors 19, 19*a* and the neutral conductors 20, 20*a* in each case can be disposed at an angle of 90° relative to each other in superposed planes 13*a*. The protective grounded conductor 19, 19*a* and the neutral conductor 20, 20*a* can be produced from flat parts.

The signal line 21 can be made of a flat part. The flat part can exhibit a first upper section bent toward the input 22 of the connector clamp 22 and a second section, following to the first section, bent downwardly into the lower plane 13*a*. The flat part of the signal line can form the connection to the coil contact 21*a*.

The pluggable base plate modules 2 can be formed at their front faces 33*a*, 33*b* in each case with a plug guide 31 for the connector modules 13.

The plug guide 31 can comprise at the connector modules 13 a dovetail spring 32. The dovetail spring 32 can be closed at an end 35. The plug guide 31 can comprise at the base plate module 2 an open dovetail groove 34 running through a side of base plate module 2.

An actuating slider 36 for a spring-supported bolting plate 37 can be furnished at the connector module 13. The actuacting slider 36 can effect the bolting and unbolting, respectively, of the solenoid valve 9.

The fluidic connector strip is formed by a metal strip 1 and several base plate modules 2 as well as by a connector part 3. The metal strip 1 is not necessarily required. The base plate modules 2 can be connected to each other by springingly operating, hook-shaped projections 4 wherein, in each case, an extension 5 of the pressure means conduit engages with an inserted sealing ring 6 into the neighboring base plate module 2.

Figure 1:
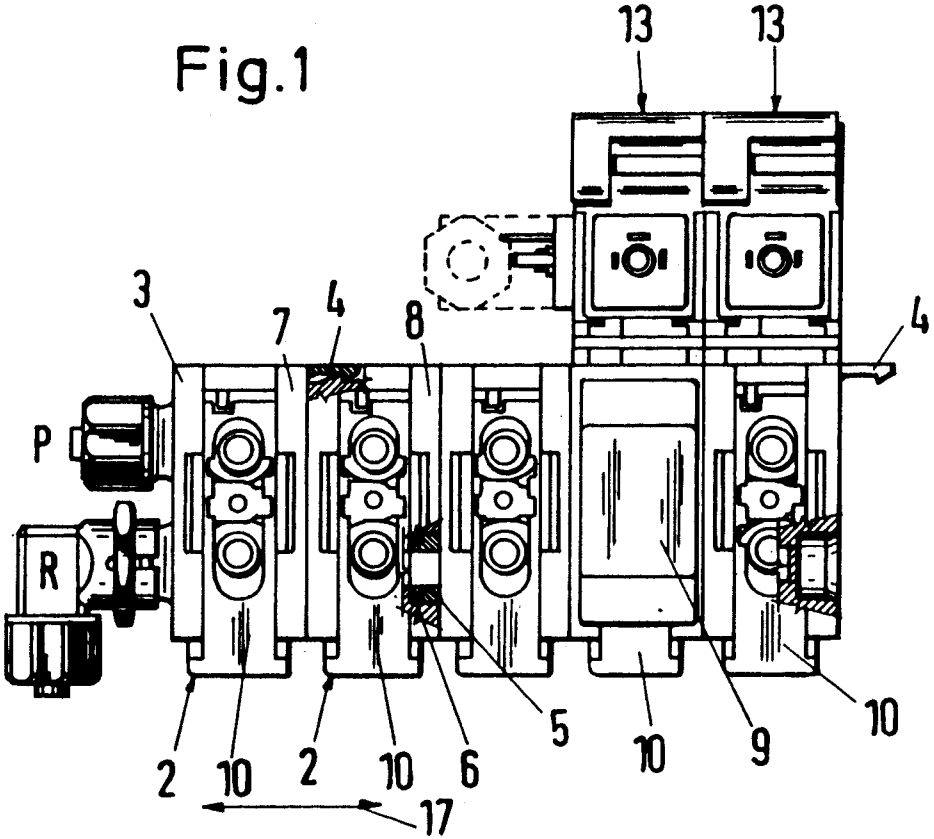
FIG. 1 is an overall side elevational and in part sectional view of the fluidic connector strip with base plate modules with solenoid valves, and the connector modules.

As illustrated in FIG. 1, an input plate 7, with pipe or tubing port, or a passage plate 8, respectively, can in each case be attached or inserted, respectively, next to one base plate module 2. A solenoid valve 9 is coordinated to each base plate module 2. Each solenoid valve 9 is connected with its connector port 11 and with sealing rings 12 by actuating a spring-supported bolt 10. Each solenoid valve 9 exhibits in addition a connector for the coil terminals, which include a protective grounded conductor to be described in more detail, a signal line, and a neutral conductor. The protective grounded conductor and/or the neutral conductor are designated in the context of the present specification and claims as protective conduit. The electrical connection is generated by a pluggable connector module 13.

Figure 3:
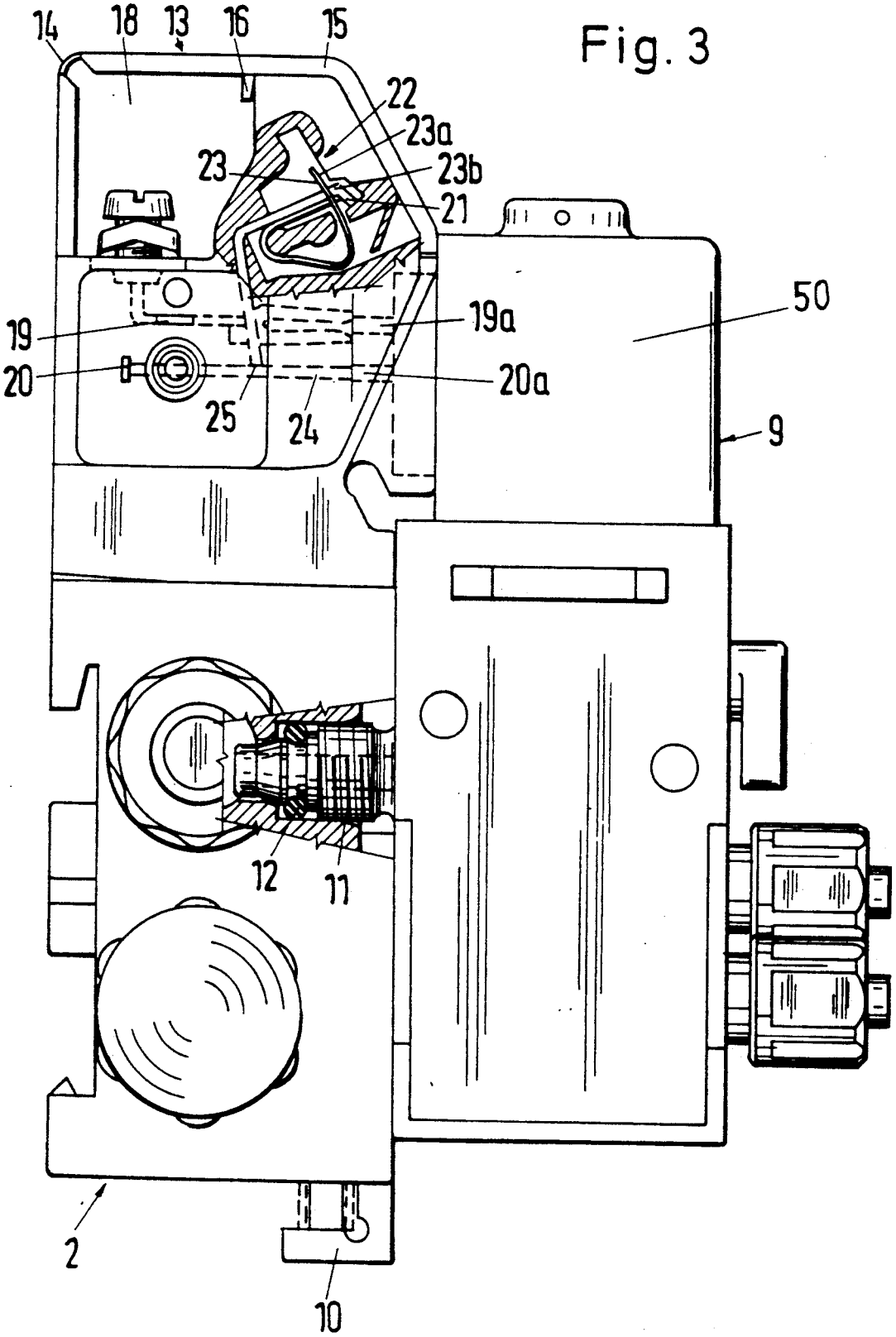
FIG. 3 is an enlarged representation of the embodiment of FIG. 2 including a showing of individual components.

Each connector module 13, illustrated in FIG. 3, includes initially a cover flap 15 with a locking projection 16, which cover flap 15 can be flapped open and closed via an elastic film hinge 14. A cable channel 18, running in longitudinal direction 17 (FIG. 1) of the strip, is disposed under the cover flap 15. A protective grounded conductor 19, a neutral conductor 20, and a signal line 21 are then placed into the interior of the connector module 13. The protective grounded conductor 19*a* and the neutral conductor 20*a*, corresponding to the side of the solenoid valve 9, are illustrated in FIG. 3 with a dashed line. The signal line 21, on the solenoid valves side designated as signal line 21*a*, is furnished for each connector module 13, and a connector clamp or connecting terminal 23 for a signal line cable 21*b* is formed at an input 22. A spring 23*a* generates a clamping action and simultaneously the spring 23*a* provides a contact 23*b* with the signal line 21.

In addition, the signal line 21 forms a connection terminal contact 25 to a corresponding coil contact at an output 24. The neutral conductor 20*a* is also connected to the coil contact.

Figure 5A:
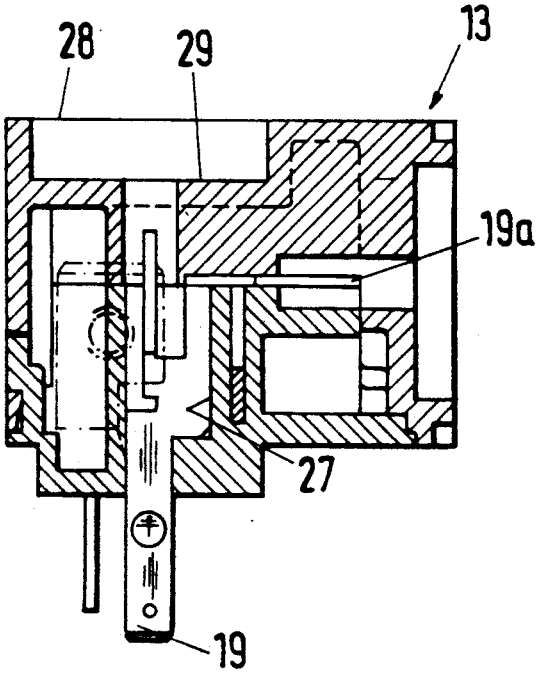
FIG. 5*a* is a section of the connector module at an enlarged scale, along the section line A—A, according to FIG. 4.
Figure 5B:
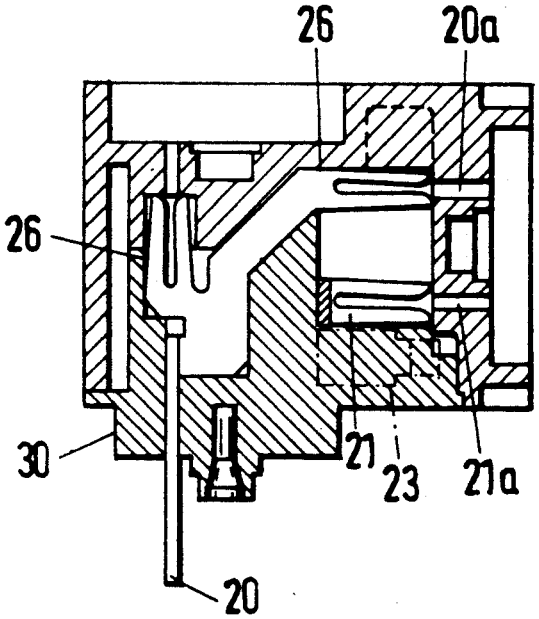
FIG. 5*b* is a section of the connector module at an enlarged scale, along the section line B—B, according to FIG. 4.

The course of contact piece 26, belonging to the neutral conductor 20, and of a contact sheet metal piece 27, belonging to the protective grounded conductor 19, is visible in FIGS. 5*a* and 5*b*. Similarly, the shape and position of the connector clamp 23 can be seen in FIG. 5*b*. The side deflection of the shape of the signal line 21 is also visible in FIG. 5*b*.

In the connector module 13, made of a non-conducting plastic material, there are disposed in superposed planes 13*a* in each case a protective grounded conductor 19 and a neutral conductor 20 each made of flat parts. These protective grounded conductors 19 and the neutral conductors 20, made of flat parts, run substantially perpendicular relative to each other's flat plane in the superposed planes 13*a*. In the context of the present invention, a protective conduit can be either a protective grounded conductor or a neutral conductor.

A recess 29 for an oppositely disposed plate projection 30, belonging to the neighboring connector module 13, is molded at a left connector side 28 of the connector module 13 (FIGS. 5*a* and 5*b*). Consequently, each connector module 13 can be plugged, by way of plate projections 30, into the recess 29 of the neighboring connector module 13, whereby the neutral conductor 20 and the protective grounded conductor 19 are contacted and simultaneously generate a current passing connection.

Figure 4:
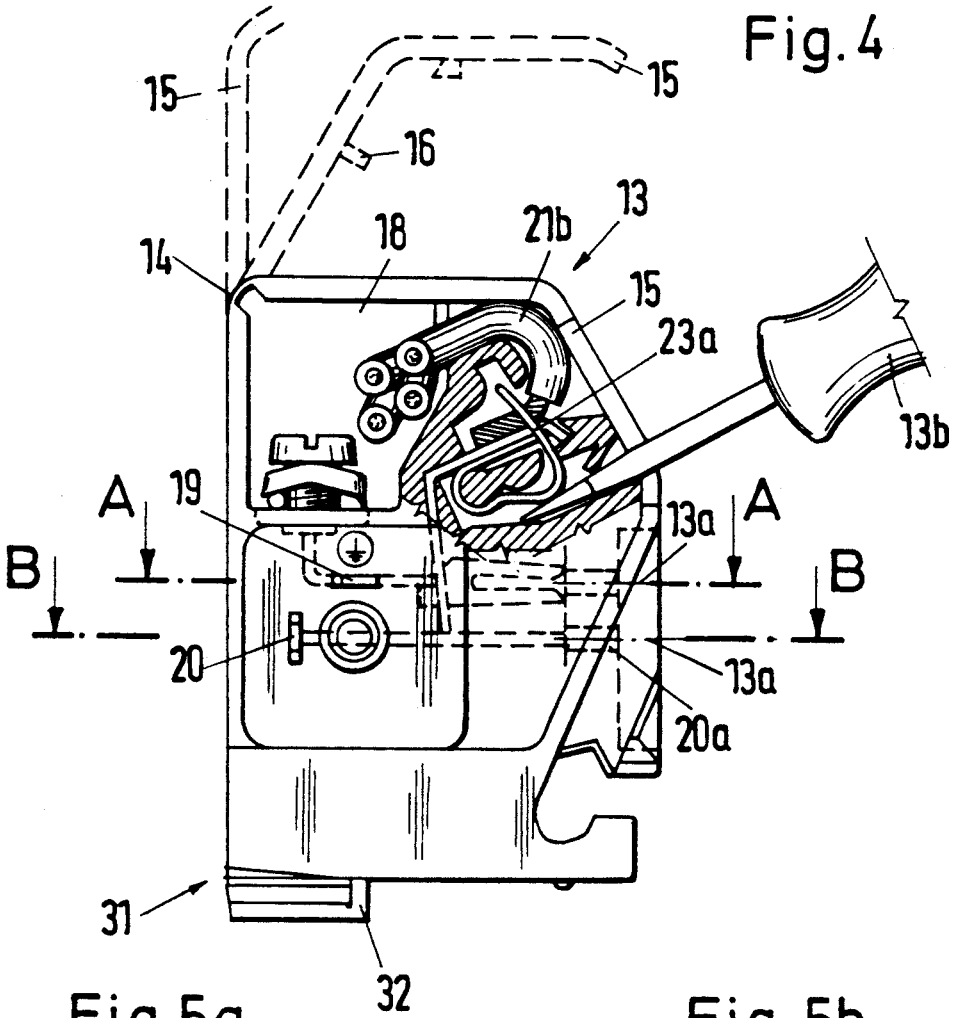
FIG. 4 is a side view at an enlarged scale of the connector module.

Thus, based on the plug connection of the connector modules 13 among themselves at least the neutral conductor 20 and/or the protective grounded conductor 19 is current-passing throughout the complete solenoid valve battery and is contacted throughout upon completion of the plugging process. Only the signal line cable 21*b* is to be plugged individually at each connector modules 13. However, the individual plugging is again substantially simplified by the connector clamp 23. Thus, according to the screw driver 13*b* illustrated in FIG. 4, it is only necessary that this screw driver 13*b* is inserted in the arrow direction of FIG. 3 in order to lift up the spring 23*a* and to insert the signal line cable 21*b*. Alternatively, the screw driver 13*b* is inserted in the direction toward its tip as shown in FIG. 4. This simple handling operation substantially simplifies the use of the solenoid valve battery upon connection to the location and/or support structure of application.

Figure 6:
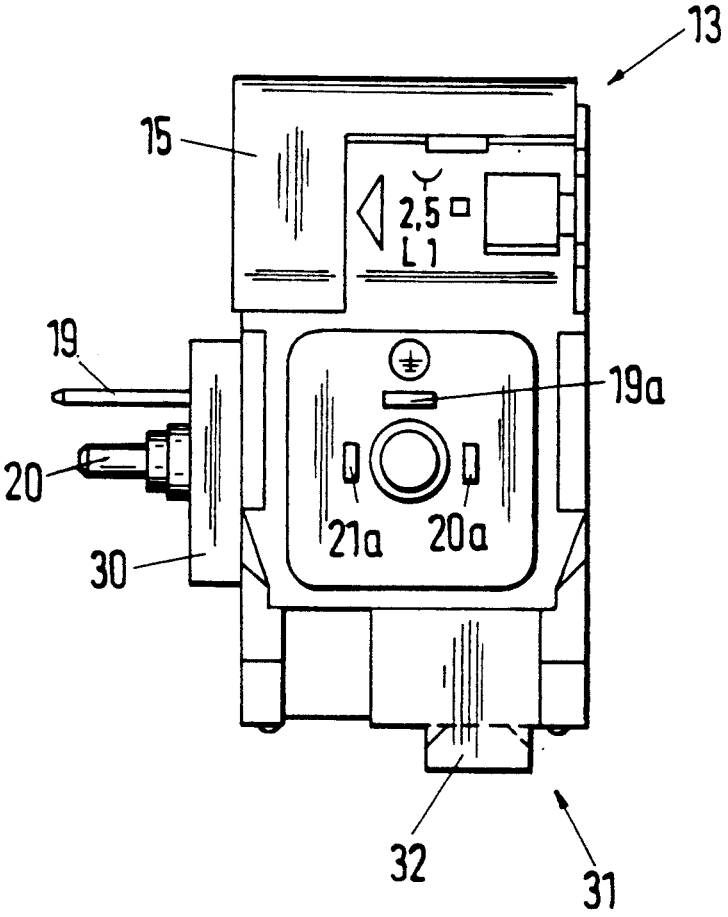
FIG. 6 is a further side view of the connector module at the same enlarged scale as employed in FIG. 4.
Figure 7:
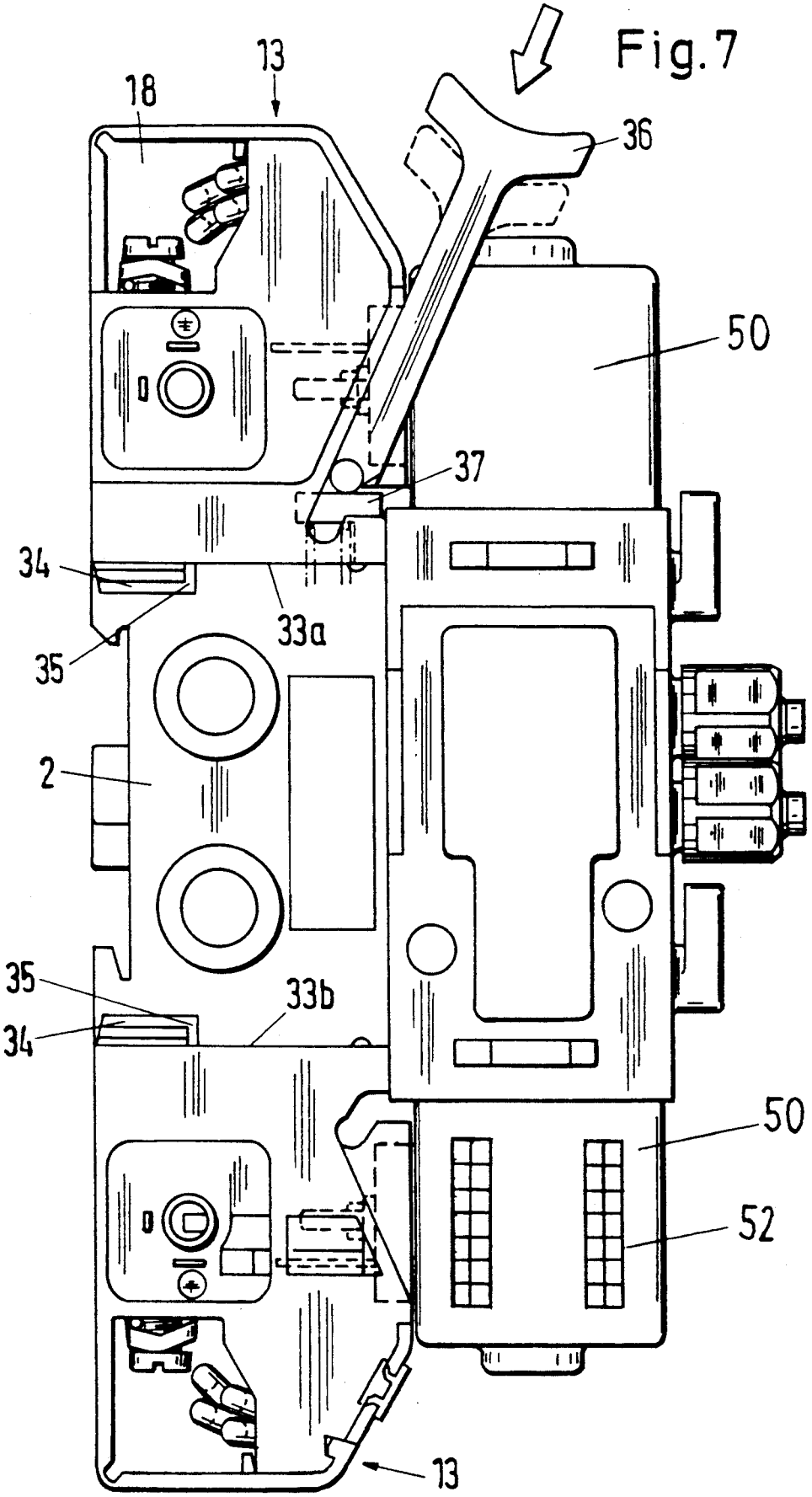
FIG. 7 is a side elevational view similar to the view of FIG. 2 for an alternative embodiment at an enlarged scale.

Each connector module 13 exhibits a plug guide 31, illustrated in FIGS. 4 and 6. The plug guide 31 comprises a dovetail spring 32 at the connector module 13. In each case, a corresponding dovetail groove 34 is disposed at the front faces 33*a* and 33*b* of the base plate module 2, as illustrated in FIG. 7. The plug guide 31 at the connector module 13 comprises a particular dovetail spring 32 which is closed at one end 35. The plug guide 31 in contrast comprises a passing throughout, open dovetail groove 34 at the base plate module 2.

As is illustrated in FIG. 7, a connector module 13 can be disposed both at the upper front face 33*a* as well as at the lower front face 33*b*. Correspondingly, the disposition of the solenoid valve is adapted. All other features are performed and implemented in the embodiment of FIG. 7 or in other figures as described.

An actuating slider 36 for a spring-supported bolting plate 37 can be disposed at the connector module 13. The spring-supported bolting plate 37 effects the bolting or debolting, respectively, of the solenoid valve 39.

It will be understood that each of the elements described above, or two or more together, may also find a useful application in other types of fluid connection strips differing from the types described above.

While the invention has been illustrated and described as embodied in the context of a fluid connection strip with base plate modules and a solenoid valve for each module, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims

1. A fluidic connector module for forming a fluidic connected strip comprising a base plate module including first base plate module attachment means and second base plate module attachment means;

a solenoid valve including an armature, a coil with coil contacts, first solenoid valve attachment means and second solenoid valve attachment means, with a protective conduit and with a signal line including a coil contact, said solenoid valve being attached with the first solenoid valve attachment means to the first base plate module attachment means of the base plate module;

a first pluggable connector module including first pluggable connector module attachment means for attaching to the second base plate module attachment means; second pluggable connector module attachment means of the first pluggable connector module with a protective conduit and with a signal line for attachment to the second solenoid valve attachment means of the solenoid valve and with an output having a terminal contact connector to engage the coil contact;

third pluggable connector module attachment means of the first pluggable connector module with a protective conduit and with a signal line for attachment to a fourth pluggable connector module attachment means of a second like pluggable connector module;

fourth pluggable connector module attachment means of the first pluggable connector module with a protective conduit and with a signal line for attachment to a third pluggable connector module attachment means of a third like pluggable connector module, wherein the third pluggable connector module attachment means of the first pluggable connector module is plug connectable to the fourth pluggable connector module attachment means of the second pluggable connector module, wherein the third pluggable connector module attachment means of the first pluggable connector module and the fourth pluggable connector module attachment means of the first pluggable connector module are disposed such that like pluggable connector modules attached to the third pluggable connector module attachment means of the first pluggable connector module and attached to the fourth pluggable connector module attachment means of the first pluggable connector module have corresponding points of the second pluggable connector module and of the third pluggable connector module disposed on respective parallel straight lines, and wherein the protective conduit and the signal line are through-connected through the first pluggable connector module, the second pluggable connector module, and the third pluggable connector module in an attachment position;

a connector clamp attached to the signal line furnished individually at the connector module for a signal line cable at an input.

2. The fluidic connector module according to claim 1, wherein the connector module is made of a non-conducting plastic material; and further comprising a protective grounded conductor produced of a flat part and disposed in a superposed plane relative to the protective conduit in the connector module.

3. The fluidic connector module according to claim 2, wherein the protective grounded conductor and the protective conduit are disposed at an angle of 90° relative to each other in the superposed planes; and wherein the protective grounded conductor and the protective conduit are produced from flat parts.

4. The fluidic connector module according to claim 1, wherein the connector module is made of a non-conducting plastic material; and further comprising a neutral conductor produced of flat parts and disposed in superposed planes relative to the protective conduit in the connector module.

5. The fluidic connector module according to claim 4, wherein the protective conduit and the neutral conductor are disposed at an angle of 90° relative to each other in the superposed planes; and wherein the protective conduit and the neutral conductor are produced from flat parts.

6. The fluidic connector module according to claim 1, wherein the signal line of the pluggable connector is made of a flat part, which exhibits a first upper section bent toward an input of the connector clamp and a second section, following to the first section, bent downwardly into a lower plane, which flat part of the signal line forms a connection to the coil contact.

7. The fluidic connector module according to claim 1, wherein the base plate module is pluggable and is formed at its front face with a plug guide for the connector module.

8. The fluidic connector module according to claim 7, wherein a plug guide is disposed at the connector module and comprises a dovetail spring closed at an end of the dovetail spring;

and wherein said plug guide at the base plate module comprises an open dovetail groove running through a side of the base plate module.

9. The fluidic connector module according to claim 1, further comprising a spring-supported bolting plate furnished at the pluggable connector;

an actuating slider for the spring-supported bolting plate, wherein the actuacting slider effects the bolting and unbolting, respectively, of the solenoid valve.

10. A fluidic connector strip with base plate modules wherein each base plate module comprises a solenoid valve, including an armature and a coil with coil contacts, wherein a connector the coil contacts comprises in each case a protective grounded conductor, a signal line, and a neutral conductor including the following features:

a pluggable connector module (13) for the contacting of the protective grounded conductor (19), of the signal line (21), and of the neutral conductor (20), and having on one side a plurality of male plugs for the conductors and having on an opposite side a plurality of female sockets matching the male plugs; whereby said pluggable connector module can be electrically connected to a second pluggable connector module;

at least one protective grounded conductor (19) through-connected and running in the longitudinal extension direction (17) of the strip and a parallel running neutral conductor (20);

wherein the protective grounded conductor and the neutral conductor (20) can be contacted by plugging the connector module (13) together in longitudinal direction and wherein the signal line (21), furnished individually at each connector module (13), includes a connector clamp (23) for a signal line cable (**21*b*) at an input, and a terminal contact connector (25) to a corresponding coil contact (21*a*) at an output (24**).

11. The fluidic connector strip according to claim 10, wherein the connector module (13) is made of a non-conducting plastic material and wherein in each case a protective grounded conductor (**19, 19*a*) and a neutral conductor (20, 20*a*), produced of flat parts, are disposed in superposed planes (13*a*) in the connector module (13**).

12. The fluidic connector strip according to claim 11, wherein the protective grounded conductors (**19, 19*a*) and the neutral conductors (20, 20*a*) in each case are disposed at an angle of 90° relative to each other in superposed planes (13*a*), and wherein the protective grounded conductor (19, 19*a*) and the neutral conductor (20, 20*a***) are produced from flat parts.

13. The fluidic connector strip according to claim 10, wherein the signal line (21) is made of a flat part, which exhibits a first upper section bent toward the input (22) of the connector clamp (22) and a second section, following to the first section, bent downwardly into the lower plane (**13*a*), which flat part of the signal line forms the connection to the coil contact (21*a***).

14. The fluidic connector strip according to claim 10, wherein the pluggable base plate modules (2) are formed at their front faces (**33*a*, 33*b*) in each case with a plug guide (31) for the connector modules (13**).

15. The fluidic connector strip according to claim 14, wherein the plug guide (31) comprises at the connector modules (13) a dovetail spring (32), which dovetail spring (32) is closed at an end (35), and wherein the plug guide (31) comprises at the base plate module (2) an open dovetail groove (34) running through a side of base plate module (2).

16. The fluidic connector strip according to claim 10, wherein an actuating slider (36) for a spring-supported bolting plate (37) is furnished at the connector module (13), which actuacting slider (36) effects the bolting and unbolting, respectively, of the solenoid valve (9).

17. A fluidic connector module for forming a fluidic connected strip comprising a base plate module including first base plate module attachment means and second base plate module attachment means;

a solenoid valve including first solenoid valve attachment means and second solenoid valve attachment means, with a protective conduit and with a signal line including a coil contact, said solenoid valve being attached with the first solenoid valve attachment means to the first base plate module attachment means of the base plate module;

a first pluggable connector module including first pluggable connector module attachment means for attaching to the second base plate module attachment means; second pluggable connector module attachment means of the first pluggable connector module with a protective conduit and with a signal line for attachment to the second solenoid valve attachment means of the solenoid valve and with an output having a terminal contact connector to engage the coil contact;

third pluggable connector module attachment means of the first pluggable connector module with a protective conduit and with a signal line for attachment to a fourth pluggable connector module attachment means of a second like pluggable connector module;

fourth pluggable connector module attachment means of the first pluggable connector module with a protective conduit and with a signal line for attachment to a third pluggable connector module attachment means of a third like pluggable connector module, wherein the third pluggable connector module attachment means of the first pluggable connector module is plug connectable to the fourth pluggable connector module attachment means of the second pluggable connector module, wherein the third pluggable connector module attachment means of the first pluggable connector module and the fourth pluggable connector module attachment means of the first pluggable connector module are disposed such that like pluggable connector modules attached to the third pluggable connector module attachment means of the first pluggable connector module and attached to the fourth pluggable connector module attachment means of the first pluggable connector module have corresponding points of the second pluggable connector module and of the third pluggable connector module disposed on respective parallel straight lines, and wherein the protective conduit and the signal line are through-connected through the first pluggable connector module, the second pluggable connector module, and the third pluggable connector module in an attachment position;

a connector clamp attached to the signal line furnished individually at the connector module for a signal line cable at an input.

18. The fluidic connector strip according to claim 17 wherein the base plate module and the pluggable connector module (13) are plug-connectable.

19. The fluidic connector strip according to claim 17, wherein the signal line (21) is made of a flat part, which exhibits a first upper section bent toward the input (22) of the connector clamp (22) and a second section, following to the first section, bent downwardly into the lower plane (13*a*), which flat part of the signal line forms the connection to the coil contact (21*a*).

20. The fluidic connector strip according to claim 17, wherein the pluggable base plate modules (2) are formed at their front faces (33*a*, 33*b*) in each case with a plug guide (31) for the connector modules (13).

21. A fluidic connector strip comprising a base plate module including a solenoid valve, an armature and a coil with coil contacts;

a pluggable connector module (13) for the contacting of the protective grounded conductor (19), of the signal line (21), and of the neutral conductor (20) and having on one side a plurality of male plugs for the conductors and having on an opposite side a plurality of female-sockets matching the male plugs, whereby said pluggable connector module can be electrically connected to a second pluggable connector module;

at least one protective grounded conductor (19) through-connected and running in the longitudinal extensions direction (17) of the strip and a parallel running neutral conductor (20);

wherein the protective grounded conductor and the neutral conductor (20) can be contacted by plugging the connector module (13) together in longitudinal direction and wherein the signal line (21), furnished individually at each connector module (13), includes a connector clamp (23) for a signal line cable (21*b*) at an input, and a terminal contact connector (25) to a corresponding coil contact (21*a*) at an output (24).

* * * * *